United States Patent [19]

Gupta

[11] 4,139,137

[45] Feb. 13, 1979

[54] FASTENER DRIVING TOOL

[76] Inventor: Harish C. Gupta, 3841 Bellaire Dr., Downers Grove, Ill. 60515

[21] Appl. No.: 758,493

[22] Filed: Jan. 11, 1977

[51] Int. Cl.[2] ..... B25C 1/06

[52] U.S. Cl. ..... 227/123

[58] Field of Search ..... 227/110, 120, 123, 130, 227/10

[56] References Cited

U.S. PATENT DOCUMENTS

| | | | |
|---|---|---|---|
| 2,472,032 | 5/1949 | Wandel | 227/123 |
| 2,857,596 | 10/1958 | Allen et al. | 227/130 |
| 3,099,012 | 7/1963 | Wandel | 227/123 |
| 3,259,292 | 7/1966 | Maynard | 227/8 |
| 3,895,752 | 7/1975 | Hatayama et al. | 227/10 |
| 3,905,535 | 9/1975 | Novak et al. | 227/120 |

*Primary Examiner*—Granville Y. Custer, Jr.

[57] ABSTRACT

A quieter, more rugged, more servicable and more versatile pneumatic fastener driving tool having an improved pneumatic exhaust dampening device, a more secure mounting between the magazine and the driving chamber, a quick-release chamber door system for swift access to the driving chamber, and an arrangement for positioning the magazine in a plurality of angles to the tool housing.

4 Claims, 6 Drawing Figures

FASTENER DRIVING TOOL

BACKGROUND OF THE INVENTION

Prior pneumatic fastener driving tools have lacked quiet operation, secure and lasting magazine mounting means and easy access to the firing chamber in the event of a jam or misfire. Prior tools have also included magazines positionable at only one angle to the tool housing.

The present invention improves the quietness of the tool by reducing exhaust noise and the forces of vibration between the driving chamber housing and the attached magazine. Compared with prior tools, the present magazine and tool housing cooperate to provide a quick release access to the driving chamber to clear jammings and through a novel mounting means the present tool permits the selective placing of the magazine at various angles to the tool housing.

SUMMARY OF THE INVENTION

Broadly, the invention comprises a pneumatic fastener driving tool having an exhaust manifold chamber with a gas-deflecting and diverting unit in the chamber to muffle the sound of exiting gases; a plurality of tandemly-arranged passageways in the magazine and driving chamber for receiving a joining pin with gaskets between the adjacent surfaces of the chamber and magazine; a quick release chamber door for attending to jams and misfire. in the driving chamber and a multiposition magazine.

It is a feature that the muffler system and the magazine mounting system combine to reduce noise.

It is also a feature that the quick-release cover means and multiple position magazine provide for more versatile tool usage.

DETAILED DESCRIPTION OF THE PREFERRED EMBODIMENT

Figure 1:
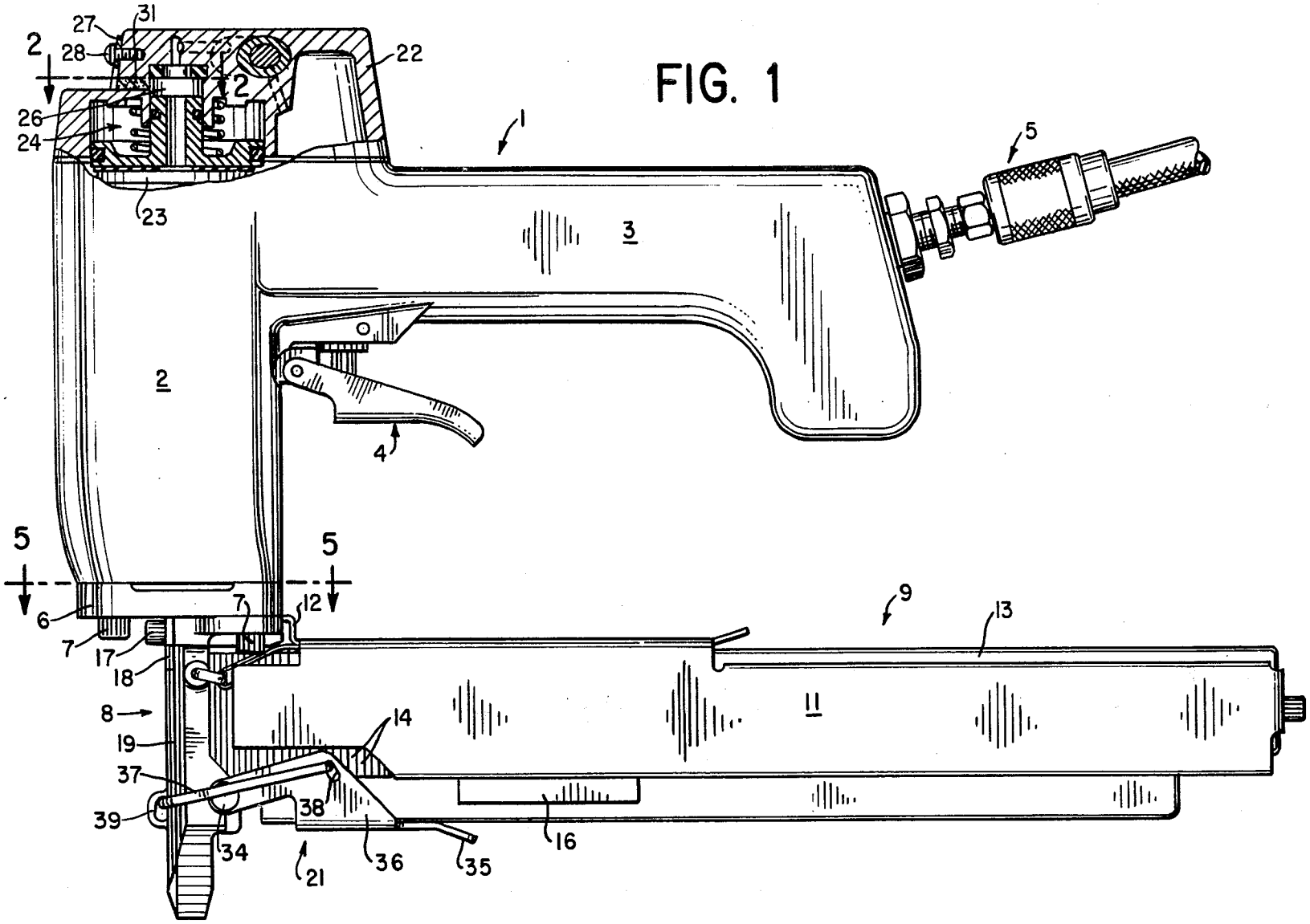
FIG. 1 is a side elevational view of the driving tool with a partial sectional view showing the cap section of the tool housing.

Referring to FIG. 1, tool housing 1 includes power cylinder portion 2 and handle portion 3. Trigger assembly 4 serves as the main control in actuating the tool. When the tool is hand held trigger assembly 4 is operated by hand and when the tool is mounted on a base, jig or other stationary base, trigger assembly 4 is operated directly by hand or through a suitable erected linkage, treadle or other remote arrangement.

Pneumatic inlet assembly 5 provides a source of pneumatic pressure to operate the power cylinder and associated valving. Lower tool housing section 6 is secured to and forms a part of tool housing 1 through removable connectors 7. Connected below housing section 6 is driving chamber housing 8 secured to section 6 through one or more of connectors 7.

Connectors 7 may be of uniform length with the depth of the holes in tool housing 1 being sufficient to receive the connectors 7 irrespective of whether they pass through only housing section 6 or both housing section 6 and housing 8.

Figures 5, 6:
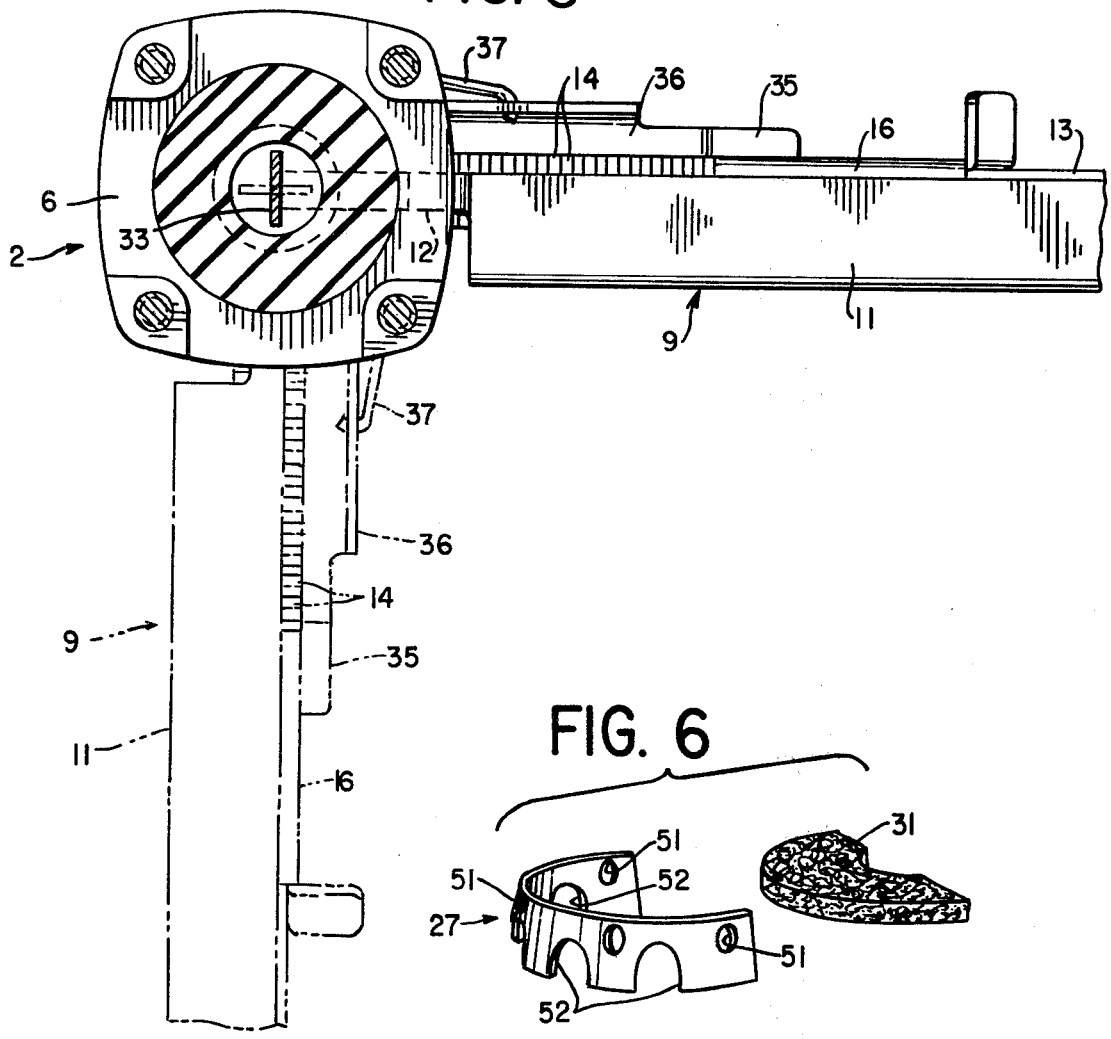
FIG. 5 is a sectional view taken along 5—5 of FIG. 1 which also shows the magazine positioned in an alternative orientation (dashed and dotted lines)
FIG. 6 is an exploded view of the exhaust manifold retainer plate and gas-deflector unit.

The above-described arrangement of the connectors 7 and the depth of the holes in tool housing 1 together with the fact that the connectors are symmetrically arranged as shown in FIG. 5 comprise means for positioning the magazine 9 at a plurality of angles to the tool housing 1. As shown in FIG. 5 one position for the magazine 9 with respect to the cylinder portion 2 of the tool housing 1 is shown in solid lines. The blade 33 is also shown in solid lines for this position of the magazine 9. In dot-dash lines in FIG. 5 the magazine 9 and the driver blade 33 are shown in a second position arranged at substantially a right angle to the solid lined position. It is merely necessary to remove the readily removable connectors 7, reposition the magazine 9 and to reinsert the connectors 7. Since the receiving holes for the connectors 7 in the cylindrical portion 2 of the tool housing are of a depth sufficient to receive the connectors 7 irrespective of whether only housing 6 or both housings 6 and 8 are between the head of the connectors 7 and the cylindrical portion 2 of the housing, this change in angularity relationship is possible without requiring different lengths of connectors 7.

Magazine 9 which is secured to driving chamber housing 8 includes magazine cowling 11 shaped to make the fasteners in the magazine readily visible so that reloading can be anticipated, magazine cowling link 12 to make the tool more rugged, elongated fastener guide element 13 for carrying the fasteners, fastener stick 14 and follower block 16 to urge the fasteners toward the driving chamber 8. For increased rigidity of the tool a bracket may be connected between handle section 3 and magazine 9. On the side opposite of driving chamber housing 8 from magazine 9 is upper driving chamber plate 18 connected to chamber housing 8 with connectors 17. Positioned below plate 18 is removable chamber door 19 which is supported by carrying and closure assembly 21. The structure and operation of assembly 21 is described below.

Also shown in FIG. 1, by partial sectional view, is cap housing section 22 of tool housing 1, power cylinder 23, poppet valve arrangement 24, valve chamber 26, exhaust manifold exit retainer 27 and connector 28.

Figure 2:
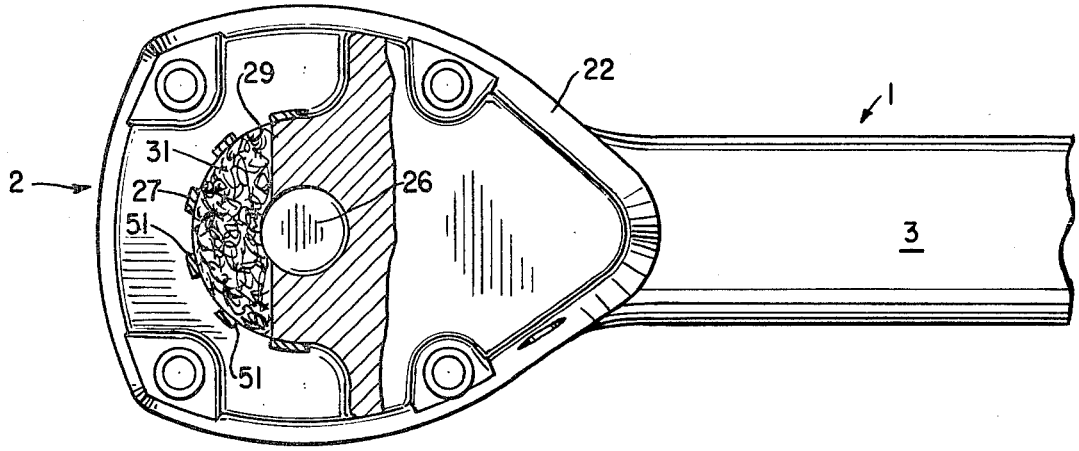
FIG. 2 is a sectional view taken along line 2—2 of FIG. 1.

Turning to FIG. 2, exhaust manifold 29 has positioned in it gas-deflector unit 31 held by exit plate retainer 27. Gases flow from valve chamber 26 through unit 31 and retainer plate 27 to atmosphere.

Figure 3:
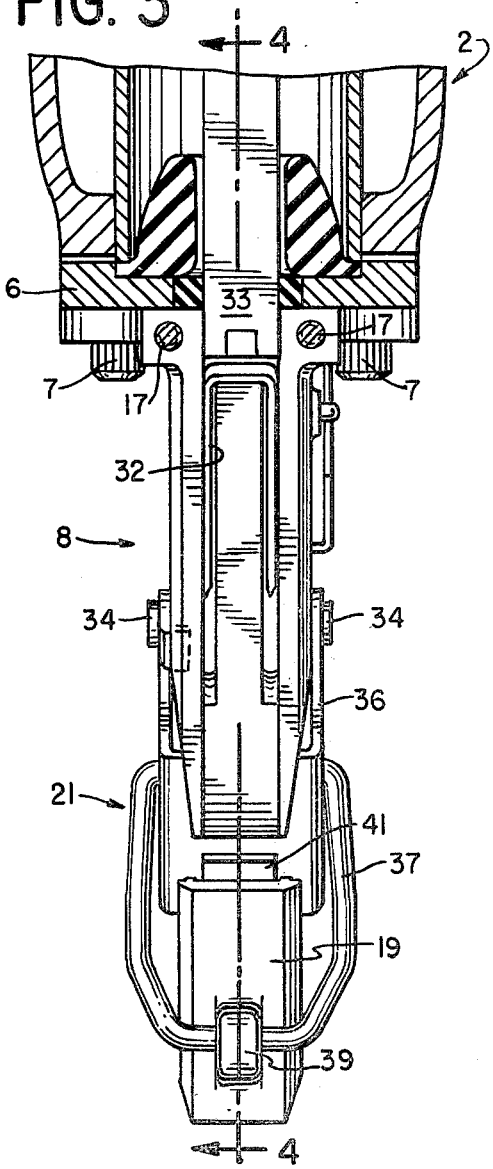
FIG. 3 is a front sectional elevational view of the driving chamber housing and access door arrangement.
Figure 4:
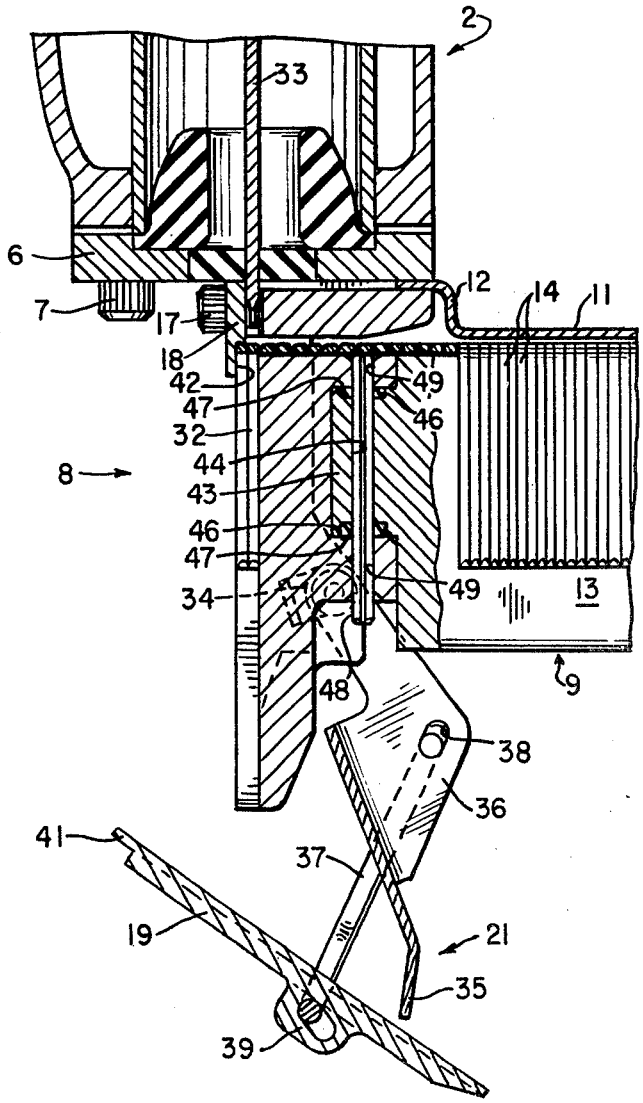
FIG. 4 is a sectional view along line 4—4 of FIG. 3.

In FIGS. 3 and 4, removable chamber housing door 19 is shown in the open position to provide access to the interior of chamber housing 8 to remove a jammed or misfired fastener. A U-shaped fastener 32 is shown ready for driving by blade 33. Door carrying and closure assembly 21 includes rotatable pin 34, bifurcated arm 36 and U-shaped holder 37. Arm 36 includes thumb piece 35. U-shaped door holder 37 which has its ends mounted in slots 38 in arm 36 passes through eyelet ring 39 on door 19. Door 19 includes lip 41 which fits in recess 42 behind upper stationary plate 18 when door 19 is moved toward and to the closed position.

Referring specifically to FIG. 4, fastener guide element 13 includes extension 43 which has a passageway 44 throughout its length. At the ends of passageway 44 are gasket-receiving recesses 46 for receiving generally-circular resilient gaskets 47 which gaskets because they protrude from or are larger than recesses 46 require compression during assembly of tool parts. Driving chamber housing 8 has two chamber passageways 49 aligned in tandem with extension passageway 44 when the magazine is assembled. Interconnecting joining pin 48 is moved or driven through the passageways 44 and 49 and through resilient gaskets 47 to secure the fastener guide element 13 to chamber housing 8. This connecting arrangement provides a gasket-to-metal engagement after assembly which substantially reduces the tendency of chamber housing 8 and fastener guide element 13 to work apart after a period of use of the tool. Loosening or working apart of these parts causes added vibration and noise in the tool during operation and may in some instances lead to a tool breakdown.

In FIG. 6, the retainer plate 27 has connector holes 51 for receiving connectors 28 (FIG. 1) and includes archway exit ports 52 through which exiting gases pass to the surrounding atmosphere. Gas-deflector unit 31 is composed of a mesh material forming a plurality of circuitous pathways through which the gases must pass before exiting the tool. Unit 31 may be made of mesh wire screen material, steel wool, perforated plastic material or any construction that will provide a plurality of gas diverting, winding and circuitous pathways. Unit 31 together with the other elements shown including retainer plate 27 require the gases to flow in a random exiting pattern from the main cylinder to atmosphere which pattern substantially reduces, dampens and muffles the noise caused by such exiting gases. The noise reducing features of the tool includes the exhaust and the magazine mounting arrangement including the resilient gaskets 47.

The quick-release door arrangement 21 which permits easy access to the driving chamber for removing jammed or unfired fasteners operates as follows: The thumb is placed against thumb piece 35 of arm 36 (shown in the nested or closed position in FIG. 1) and sufficient pressure is applied to move arm 36 downward until door holder 37 moves below the center of pivot pin 34. At this point, arm 36 and holder 37 will continue to move downward with little or no force applied, pulling and carrying door 19 to the open position (FIG. 4). Door 19 remains on holder 37 to prevent it from being misplaced and to make closing easier.

To return door 19 in the closed position, the door is oriented until door lip 41 (FIG. 4) is moved partially into recess 42, then thumb piece 35 of arm 36 is moved upwardly and to the right as viewed in FIGS. 1 and 4. As movement continues in this direction, tension in holder 37 builds up as door 19 seats against housing 8 and arm 36 continues to pull and tension holder 37. During the final segment of travel holder 37 moves above the center of pivot 34 causing door 19 to be held in locked tension since arm 36 is urged upwardly in its nested position (FIG. 1).

It is understood that any type of fastener tool using pneumatic pressure, such as a brad or a nail driving tool, may be adapted to include the features of this invention.

I claim:

1. In a pneumatic fastener driving tool having a tool housing, a pneumatic exhaust chamber into which spent gases are discharged, a driving chamber housing for holding a fastener in alignment with the driving blade and a magazine for sequentially supplying fasteners to the driving chamber housing, the improvement comprising (a) an exhaust manifold communicating with and downstream of the exhaust chamber, gas diverting means within the exhaust manifold comprising a plurality circuitous paths through which exiting gases pass and a retainer plate having a portion connected to the tool housing and a portion defining a plurality of gas exit ports;

(b) means for mounting the magazine on the driving chamber housing which means includes a passageway in the housing, a passageway in the magazine, a pin positioned in the passageways when aligned in tandem, and resilient gasket means between the chamber housing and the magazine to absorb and dampen vibration and forces tending to cause relative motion between the chamber housing and the magazine;

(c) removable cover door means on the driving chamber housing opposite said means for mounting the magazine, said cover door means supported and held in closed position by a releasable holding means comprising (i) pivotable lever means pivotably mounted in the driving chamber housing;

(ii) bracket means swivably attached to the cover means and to the pivotable lever means the lever means and bracket means being so proportioned so that as the lever means is rotated in one direction the cover means is removed and when rotated in the other direction the cover means is brought into its closed position and as the lever means is further so rotated the bracket means is moved past the pivot point of lever means to tension the cover means in the closed position; and (d) means for positioning the magazine at a plurality of angles to the tool housing comprising readily removable connectors mounting the driving chamber housing to the tool housing said connectors being positioned symmetrically about two tool housings for alignment between the driving chamber housing and the tool housing so that the chamber housing and the tool housing can be attached at a plurality of angles to one another.

2. In a pneumatic fastener driving tool having a tool housing, a pneumatic exhaust chamber into which spent gases are discharged, a driving chamber housing for holding and guiding a fastener in alignment with the driving blade and a magazine for supplying fasteners to the driving chamber housing, the improvement comprising (a) an exhaust manifold communicating with and downstream of the exhaust chamber, gas diverting means within the manifold comprising a plurality circuitous paths through which exiting gases pass and a retainer plate having a portion covering and connected to the tool housing and the remaining portion defining a plurality of gas exit ports; and, (b) means for mounting the magazine on the driving chamber housing which means includes a passageway in the housing, a passageway in the magazine, a pin positioned in the passageways when aligned in tandem, and generally circular resilient gasket means between the chamber housing and the magazine to absorb and dampen vibration and forces tending to cause relative motion between the chamber housing and the magazine.

3. A pneumatic fastener driving tool having a driving chamber and a magazine comprising means for attaching the chamber and magazine including:

(a) a passageway in the housing;

(b) a passageway in the magazine in tandem alignment with the housing passageway;

(c) a joining pin positioned in the passageways to hold the chamber and magazine together; and (d) resilient gasket means between the chamber and the magazine to absorb and dampen vibration when the joining pin is in place.

4. In a pneumatic fastener driving tool having a tool housing, a pneumatic exhaust chamber into which spent gases are discharged a driving chamber housing for holding and guiding a fastener in alignment with the driving blade and a magazine for supplying fasteners to the driving chamber housing, the improvement comprising (a) an exhaust manifold communicating with and downstream of the exhaust chamber, gas diverting means within the manifold comprising a plurality circuitous paths through which exiting gases pass and an arcuate retainer plate having a portion covering and connected to the tool housing and a portion defining a plurality of gas exit ports;

(b) means for mounting the magazine on the driving chamber housing which means includes two passageways in the housing, an intermediate passageway in the magazine, a pin positioned in the passageways when all are aligned in tandem, and a plurality of generally-circular resilient gasket means compressed between the chamber housing and the magazine to absorb and dampen vibration and forces tending to cause relative motion beteen the chamber housing and the magazine;

(c) removable cover means on the driving chamber housing opposite said means for mounting the magazine, said cover means supported and held in closed position by a releasable holding means comprising (i) pivotable lever means pivotably mounted on the driving chamber housing;

(ii) bracket means swivably attached to the cover and to the pivotable lever means the lever means and bracket means being so proportioned so that as the lever means is rotated in one direction the cover means is removed and when rotated in the other direction the cover means is brought into its closed position and as the lever means is further so rotated the bracket means is moved past the pivot point of lever means to tension the cover means in the closed position; and (d) means for positioning the magazine at a plurality of angles to the tool housing comprising connectors mounting the driving chamber housing to the tool housing; said connectors being readily removable and positioned symmetrically about two tool housings for alignment between the driving chamber and tool housing so that the chamber and housing can be easily detached and reattached at a plurality of different angles.

* * * * *

UNITED STATES PATENT AND TRADEMARK OFFICE

CERTIFICATE OF CORRECTION

PATENT NO. : 4139137

DATED : February 13, 1979

INVENTOR(S) : Harish C. Gupta

It is certified that error appears in the above–identified patent and that said Letters Patent are hereby corrected as shown below:

Assignee: Swingline, Inc., Long Island City, N.Y.

Signed and Sealed this

*Third* Day of *June 1980*

[SEAL]

*Attest:*

SIDNEY A. DIAMOND

*Attesting Officer*

*Commissioner of Patents and Trademarks*